US010012009B2

(12) United States Patent
Jahnsèn

(10) Patent No.: US 10,012,009 B2
(45) Date of Patent: Jul. 3, 2018

(54) ELECTRIC LOCK DEVICE FOR FURNITURE AND STORAGE

(71) Applicant: Swedstyle AB, Vaggeryd (SE)

(72) Inventor: Peter Jahnsèn, Vaggeryd (SE)

(73) Assignee: SWEDSTYLE AB, Vaggeryd (SE)

( * ) Notice: Subject to any disclaimer, the term of this patent is extended or adjusted under 35 U.S.C. 154(b) by 0 days.

(21) Appl. No.: 15/541,124

(22) PCT Filed: Dec. 28, 2015

(86) PCT No.: PCT/SE2015/051394
§ 371 (c)(1),
(2) Date: Jun. 30, 2017

(87) PCT Pub. No.: WO2016/108748
PCT Pub. Date: Jul. 7, 2016

(65) Prior Publication Data

US 2017/0370125 A1 Dec. 28, 2017

(30) Foreign Application Priority Data

Dec. 30, 2014 (SE) ..... 1451670

(51) Int. Cl.
*G08B 13/14* (2006.01)
*E05B 35/10* (2006.01)
(Continued)

(52) U.S. Cl.
CPC ..... *E05B 35/10* (2013.01); *E05B 47/026* (2013.01); *E05B 65/44* (2013.01);
(Continued)

(58) Field of Classification Search
CPC . E05E 35/10; E05E 65/44; G07C 9/00; G08B 23/34
(Continued)

(56) References Cited

U.S. PATENT DOCUMENTS

2008/0088454 A1 4/2008 Flores et al.
2009/0085717 A1 4/2009 Kirkjan
(Continued)

FOREIGN PATENT DOCUMENTS

GB 2480322 11/2011
WO 2011156689 A1 12/2011

OTHER PUBLICATIONS

PCT International Search Report No. PCT/SE2015/051394, dated Feb. 24, 2016, issued by the Swedish Patent Office acting as the International Searching Authority (26 pages).
(Continued)

*Primary Examiner* — Tai T Nguyen
(74) *Attorney, Agent, or Firm* — Honigman Miller Schwartz and Cohn LLP

(57) ABSTRACT

An electric lock device for furniture or storage has an RFID transmitter/receiver for communication with portable data carriers. A controller detects a data carrier nearby, reads a set of data from it, and determines if the data carrier is at least an access requesting or function determining type. If access requesting, the controller retrieves identity information from the read set of data, compares the identity information to stored reference information, and controls an electric activator for a securing member. If function determining, the controller retrieves function determining information from the read set of data and performs any of the following: switching to any of a plurality of operational modes having different principles for access control; reading an operational status; or setting an operational parameter. At least one of these actions is variable controlled and based on a variable value in the function determining information.

10 Claims, 9 Drawing Sheets

(51) Int. Cl.

| | |
|---|---|
| ***E05B 47/02*** | (2006.01) |
| ***E05B 65/44*** | (2006.01) |
| ***G07C 9/00*** | (2006.01) |
| *E05B 17/00* | (2006.01) |
| *E05B 15/02* | (2006.01) |
| *E05B 47/00* | (2006.01) |

(52) U.S. Cl.
CPC ..... *G07C 9/00309* (2013.01); *E05B 17/0037* (2013.01); *E05B 47/0012* (2013.01); *E05B 2015/0235* (2013.01); *E05B 2047/0094* (2013.01); *G07C 2009/00507* (2013.01)

(58) Field of Classification Search
USPC ..... 340/572.4–572.8, 540, 541, 539.22
See application file for complete search history.

(56) References Cited

U.S. PATENT DOCUMENTS

| | | | | |
|---|---|---|---|---|
| 2011/0074541 | A1 | 3/2011 | Jones | |
| 2012/0096909 | A1 | 4/2012 | Hart et al. | |
| 2017/0205134 | A1* | 7/2017 | Osbar | F25D 23/028 |

OTHER PUBLICATIONS

Swedstyle "FlexLOCK brochure" dated Jul. 27, 2015, retrieved from the Internet: http://issuu.com/swedstyle/docs/flexlock broschyr?e=11428630/7381435, 6 pages.

* cited by examiner

ELECTRIC LOCK DEVICE FOR FURNITURE AND STORAGE

CROSS REFERENCE TO RELATED APPLICATIONS

This application is a 35 USC § 371 United States national stage application of International Application No. PCT/SE2015/051394, filed Dec. 28, 2015, which claims priority to Swedish Application No. 1451670-2, filed Dec. 30, 2014.

FIELD OF THE INVENTION

The present invention generally relates to the technical field of lockable furniture and storage, and more particularly to an electric lock device for contactless and autonomous operation and for mounting to furniture and storage.

The invention also relates to an associated access control system for furniture and storage.

BACKGROUND OF THE INVENTION

Furniture and storage are often used for storing documents, personal belongings, equipment, clothing and other objects which have a value to the owner and which the owner of course does not want to lose or get into the wrong hands. In public environments, such as offices or public buildings, the problem is of particular importance because many people occupy such spaces. However, far from all furniture or storage have a basic design which allows locking.

There is therefore a market for electric lock devices which can be mounted to furniture and storage, either at the manufacturing stage or for retrofitting in their intended usage environment. In order to facilitate use of such electric lock devices both for the intended users of the furniture and storage and for the management of the operation in question, access to the lockable space in the piece of furniture or storage should be controlled by authorization control by means of some kind of key. Physical (mechanical) keys are the classic example, but it is nowadays more preferred to use electronic or digital keys in the form of, for instance, smart cards or proximity tags. Such keys are already used for instance for controlling the entry into offices or public buildings.

There are a number of demands and practical problems in the market for electric lock devices for furniture and storage, some of which will now be briefly referred to.

It is considered an advantage if existing electronic or digital keys, such as smart cards or proximity tags, which are already used for other reasons in the operation, could be used also for the electric lock devices.

Also, when electric lock devices are to be retrofitted to furniture or storage, it is desired for practical reasons to avoid electric wiring installations while at the same time facilitating the mounting as much as possible.

Once the electric lock devices have been mounted to the furniture or storage, the electric lock devices shall operate autonomously and at a minimum need for maintenance or special equipment.

At the same time, there should be an easy way of configuring each electric lock device as regards exactly which user or users, and hence which electronic or digital key or keys, should be authorized to control the electric lock device for unlocking and locking, respectively, of the piece of furniture or storage. This is first and foremost important for safety reasons as such. It is conversely also important to be able to swiftly and conveniently handle changes in the operation, for instance because of changes in the user group, lost keys, changes in the premises, etc. Sooner or later it is very likely that every electric lock device needs to be reconfigured to, for instance, reflect that the authority of an existing user is to be removed, authority is to be added for a new user, etc.

Furthermore, there may be different needs in different parts of the operation (or between different operations) as regards the access control principles which shall apply to the lock devices. Examples of different access control principles can be whether the piece of furniture or storage shall be initially unlocked or locked, whether locking shall occur automatically or manually, whether just one or several different users shall be able to operate the lock device in each given situation, or whether locked condition shall prevail until further notice or only during a certain period, and if so for how long.

As appears from the above, there is room for improvements in the field of lockable furniture and storage.

SUMMARY OF THE INVENTION

In consideration of the above, an objective of the invention to solve or at least mitigate one or more of the problems discussed above, and fully or partly meet the demands referred to above, respectively.

Accordingly, a first aspect of the present invention is an electric lock device for furniture and storage, comprising an apparatus housing for mounting of the lock device to a first part of a piece of furniture or storage which further has a second part, wherein the first and second parts can be opened and closed with respect to each other. The electric lock device has a local power source for powering the lock device as an autonomously operating device, and furthermore an RFID transmitter/receiver being capable of contactless communication with portable data carriers in a vicinity of the lock device.

The electric lock device also has a controller and a memory which is associated with the controller and adapted to store reference information defining a set of access-approved portable data carriers. An electric activator, such as an electric motor, in the lock device is coupled for activating a lock actuator upon receiving a control signal from the controller, to cause the lock actuator to release or retain a securing member mounted to the second part of said piece of furniture or storage.

The controller in the electric lock device is configured to:

- detect that a portable data carrier is present in a vicinity of the lock device;
- read, through said RFID transmitter/receiver, a set of data from a memory in the portable data carrier;
- based on the read set of data, determine a type of the portable data carrier among at least the following possible types: access requesting type or function determining type;
- if the portable data carrier is of access requesting type, retrieve identity information for the portable data carrier from the read set of data, compare the identity information to the reference information stored in said memory, and in response to a positive comparison result control the electric activator to cause the lock actuator to release or retain a securing member;
- if the portable data carrier is of function determining type, retrieve function determining information from the read set of data and in response perform any of the following actions affecting the operation of the lock device:

switch to any of a plurality of different operational modes having different principles for access control;

read an operational status of the lock device; or set an operational parameter of the lock device, wherein at least one of the operation-affecting actions is variable-controlled and based on a variable value comprised in the function determining information retrieved from the read set of data.

An electric lock device of this kind solves or at least mitigates one or more of the problems discussed above in the background section, and/or fully or partly meets one or more of the demands referred to above in the background section.

A second aspect of the present invention is an access control system for furniture and storage, comprising: a first number of electric lock devices, each defined in accordance with the first aspect of the invention as referred to above, a second number of portable data carriers, and a central unit with an associated RFID transmitter/receiver capable of writing function determining information and/or identity information to the memory in an individual portable data carrier among said second number of portable data carriers.

The portable data carriers are preferably contactless smart cards or proximity tags.

Other objectives, features and advantages of the present invention will appear from the following detailed description as well as from the drawings.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above as well as further objectives, features and advantages of the present invention will be understood more thoroughly by the forthcoming illustrating and non-limiting detailed description of exemplifying embodiments of the present invention, reference being made to the accompanying drawings.

DETAILED DESCRIPTION OF EMBODIMENTS

Figure 1A:
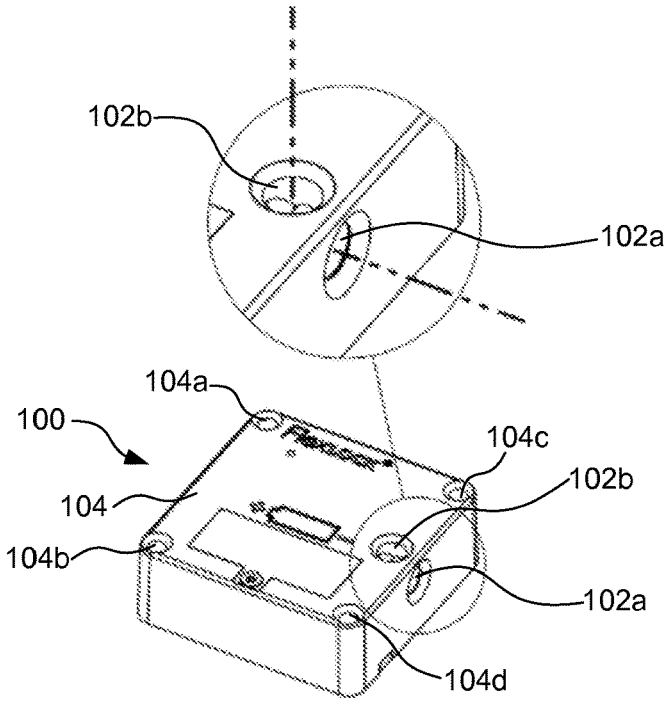
FIG. 1A is an isometric view of an electric lock device for mounting to a first part of a piece of furniture or storage.
Figure 1B:
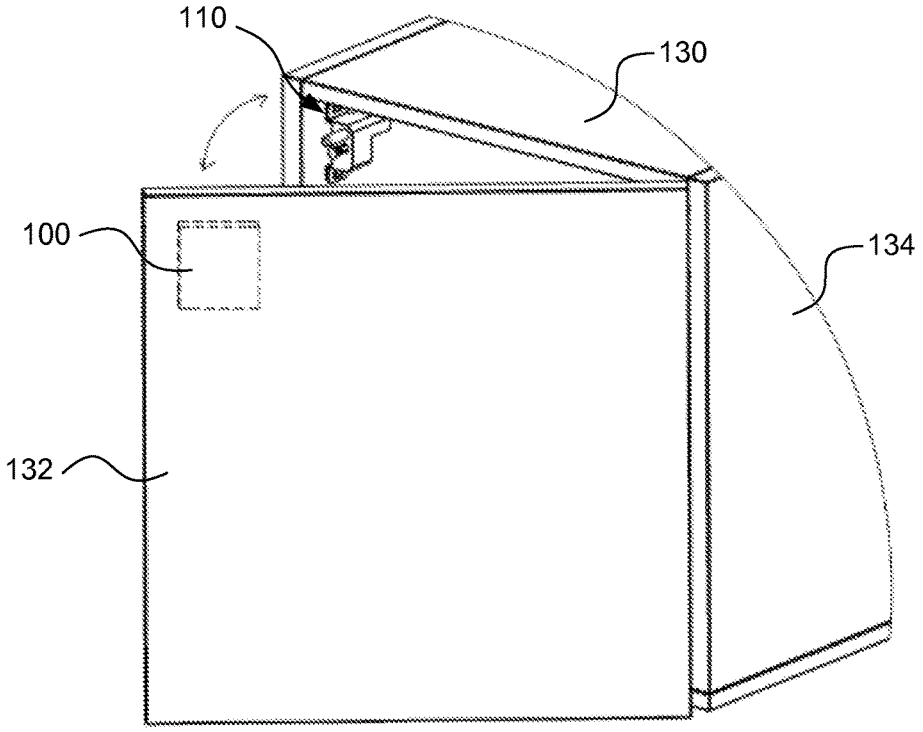
FIG. 1B schematically shows the electric lock device mounted to the first part of an exemplifying piece of furniture or storage which furthermore has a second part, wherein the first and second parts can be opened and closed with respect to each other.
Figure 1C:
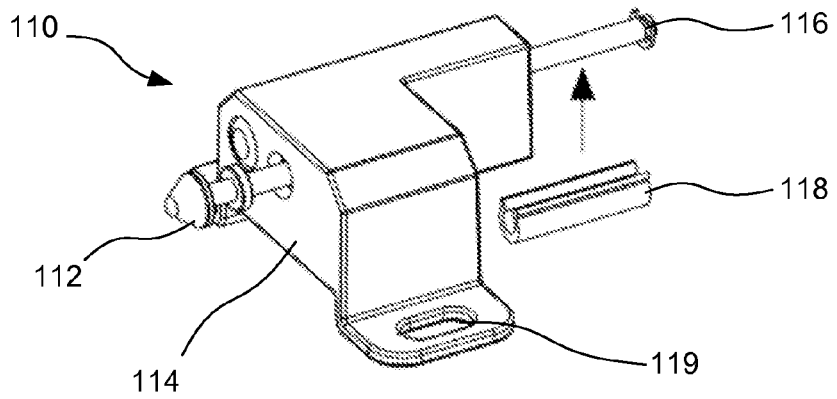
FIG. 1C is an isometric view of a first design of a securing member that the electric lock device interacts with in order to allow locking and unlocking, respectively, of the piece of furniture or storage by the user bringing a portable data carrier that the electric lock device interrogates or reads.
Figure 1D:
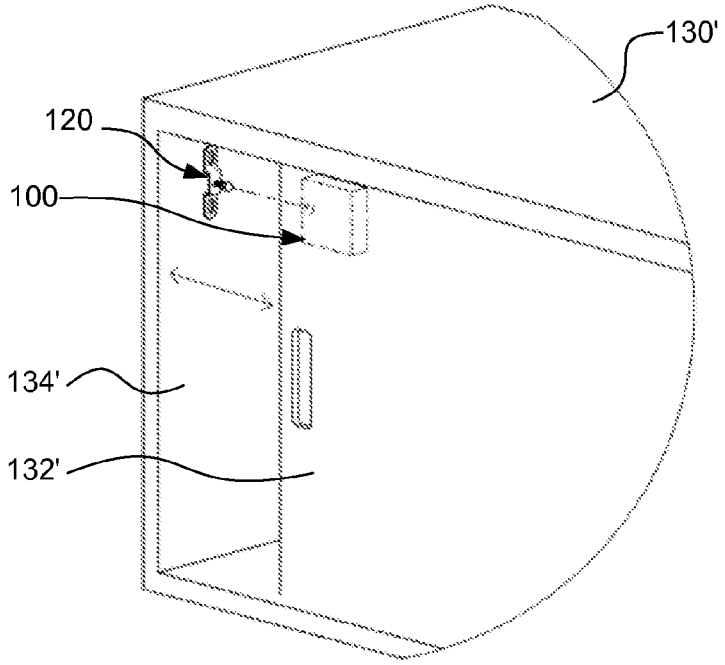
FIG. 1D schematically shows the electric lock device mounted to the first part of another exemplifying piece of furniture or storage.

First, it shall be briefly mentioned that FIGS. 1A-1E shows an electric lock device 100 for mounting to a piece of furniture or storage 130, 130'. The lock device 100 can be operated through RFID communication with portable data carriers 200, which are shown schematically as individual data carriers 202-210 in FIG. 2. The data carriers 200; 202-210 are electronic or digital keys of the kind which has been described in the preceding section, i.e. smart cards or proximity tags.

Figure 3:
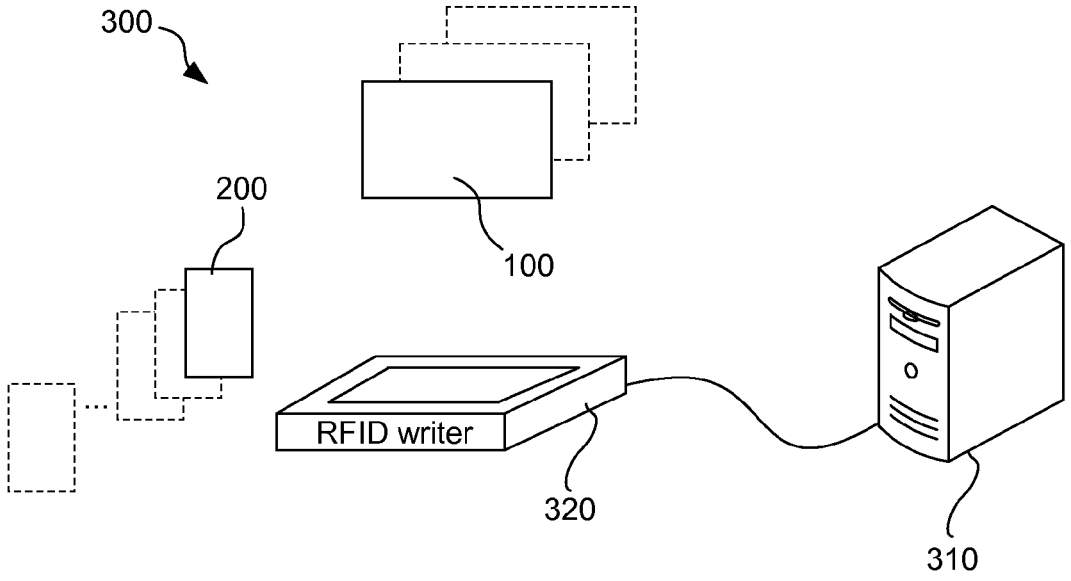
FIG. 3 is a schematic illustration of an access control system for furniture and storage, comprising a number of electric lock devices according to the above.

As appears from FIG. 3, a data carrier 200 can be provided with function determining information and/or identity information through a central unit 310 with an associated RFID transmitter/receiver 320. An access control system 300 for furniture and storage is hence formed by a first number of electric lock devices, each implemented as the electric lock device 100, together with a second number of portable data carriers 200; 202-210 and the central unit 310 with its associated RFID transmitter/receiver 320.

FIGS. 4, 5 and 6A-6D show the electric lock device 100 and the portable data carrier 200, respectively, in detail, as will be described in more detail later.

Reference is now again made to FIGS. 1A-1C, which together show how the electric lock device 100 has been mounted to a first part 132 of a piece of furniture or storage 130 which moreover has a second part 134. The first and second parts 132, 134 can be opened and closed with respect to each other. For the mounting, suitable anchoring means, such as screw or bolts, are preferably used in order to secure the electric lock device 100 to the first part 132 of the piece of furniture or storage 130. Openings 104*a-d* for such anchoring means are provided in the apparatus housing 104 of the lock device 100.

Figure 1E:
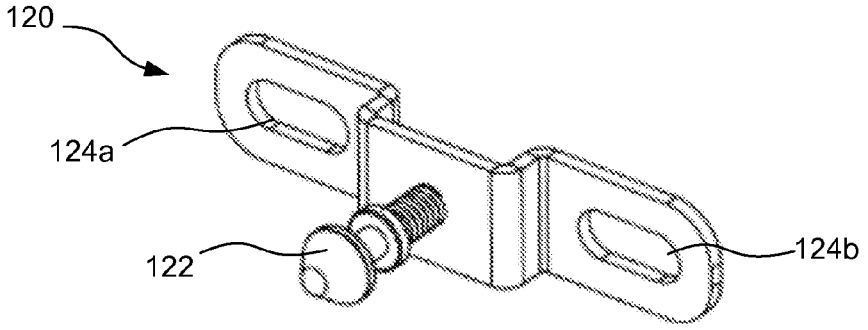
FIG. 1E is an isometric view of a second design of a securing member that the electric lock device interacts with in order to allow locking and unlocking, respectively, of the piece of furniture or storage.
Figure 2:
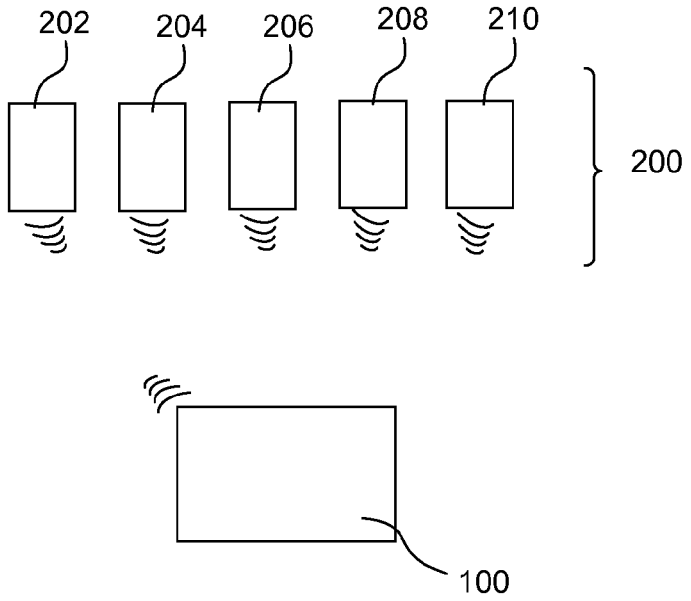
FIG. 2 schematically illustrates the electric lock device and a set of portable data carriers.

The apparatus housing 104 further has two openings 102*a*, 102*b*, through which the lock device 100 can receive a protruding part 112 of a securing member 110 (a different design of a securing member 120 is shown in FIG. 1E). The purpose of the securing member 110 is to interact with the lock device 100 and hence allow locking and unlocking, respectively, of the piece of furniture or storage 130, so that the first and second parts 132, 134 can be opened with respect to each other, and kept in a fixed position with respect to each other, respectively.

The securing member 110 is mounted by suitable anchoring means, such as screw or bolts (see openings 119 in FIG.

1C), on the second part 134 of the piece of furniture or storage 130, as appears from FIG. 1B. The reason why the apparatus housing 104 has two openings 102*a*, 102*b* in this embodiment is to offer more flexibility as regards how the lock device 100 and the securing member 110 (and 120, respectively) can be mounted spatially with respect to each other, which offers better flexibility since the lock device 100 can be used for different types of furniture or storage. In the design according to FIG. 1C, the protruding part 112 of the securing member 110 is intended to fit in the opening 102*b* in the electric lock device 100.

The securing member 110 in FIG. 1C is not central to the invention and is therefore only described in brief. The securing member 110 is in particular intended for drawers, hatches and sliding doors, and has a body 114 and an ejector 116 for automatic opening of the drawer, hatch or sliding door upon unlocking by means of the lock device. The ejector 116 is hence arranged to open the drawer, hatch or sliding door by a certain amount, such as 20 mm. The function of the ejector 116 can be deactivated, if desired at installation, by use of a blocking member 118.

FIG. 1D shows the electric lock device 100 mounted to the first part 132' of a piece of furniture or storage 130' of a different kind. As appears from FIG. 1E, the securing member 120 here has a different design to interact with the lock device 100 and allow locking and unlocking, respectively, of the piece of furniture or storage 130'. The securing member 120 is particularly intended for sliding cabinets and drawers beneath a desktop. The securing member 120 has a protruding part 122 to fit in the opening 102*a* in the electric lock device 100, as well as openings 124*a-b* for anchoring means.

In the designs above, the first part 132 and 132', respectively (to which the electric lock device 100 is mounted) is a smaller, movable part of the piece of furniture or storage 130 and 130', respectively, compared to the second, larger body part 134 and 134', respectively (to which the securing member 110 and 120, respectively, is mounted). In other designs, the relationship may however be the opposite, i.e. the lock device 100 may be mounted to a larger body part while the securing member 110 and 120, respectively, may be mounted to a smaller, movable part.

Figure 4:
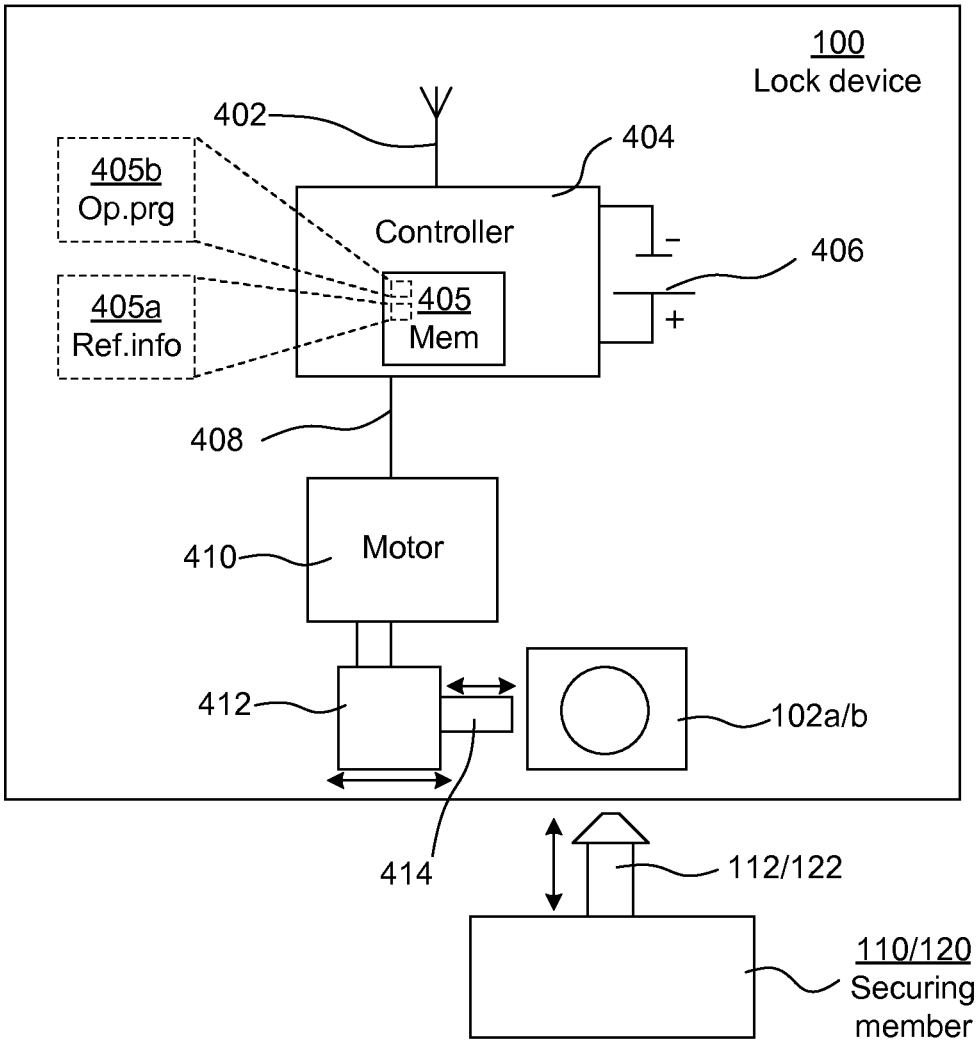
FIG. 4 is a schematic block diagram of parts comprised in the electric lock device according to the above.

FIG. 4 is a schematic block diagram of parts comprised in the electric lock device 100. The lock device 100 has an RFID transmitter/receiver 402, 404 being capable of contactless communication with portable data carriers 200 in a vicinity of the lock device. In the present embodiment, the RFID transmitter/receiver is comprised of two parts; a first part which constitutes the actual communication circuit and which is integrated with a controller 404, and a second part 402 which is an antenna. The RFID transmitter/receiver 402, 404 is adapted for contactless communication at 13.56 MHz in accordance with the ISO/IEC 14443A standard in the present embodiment.

The controller 404 is connected to a local power source 406, in the present embodiment a battery, which supplies power to the lock device 100 and allows it to operate as an autonomous device. Hence, the controller 404 acts as a power feed circuit to other parts of the lock device 100.

An electronic memory 405 is associated with the controller 404 and is intended to comprise program instructions for an operating program 405*b* to be executed by the controller 404 to perform the functions of the lock device 100 as described in this document. The memory 405 is also intended to contain reference information 405*a*, the purpose of which will appear in more detail from the subsequent description later in this document. In the present embodiment, the memory is integrated in the controller 404.

In a practical implementation, the memory 405 may comprise one or several physical memory means, being integrated with the controller 404, or alternatively being separate from but connected to the latter. The controller 404 may be implemented in any known controller technology, including but not limited to a processor (PLC, CPU, DSP), FPGA, ASIC or any other suitable digital and/or analog circuitry capable of performing the intended functionality. The memory 405 may be implemented in any known memory technology, including but not limited to E(E)PROM, S(D)RAM or flash memory.

The lock device 100 furthermore has an electric activator 410 and a lock actuator 412, 414. The electric activator 410 is an electric motor 410 in the disclosed embodiment, but may alternatively be for instance a solenoid, a piezoelectric element or similar. The lock actuator 412, 414 comprises a movable lock pin 414 and a mechanism 412 for transferring force from the motor 410 to the lock pin 414. The lock pin 414 is adapted to fit in the opening 102*a* or 102*b* according to the preceding description. The motor 410 is coupled for activating the lock actuator 412, 414 upon receiving a control signal 408 from the controller 404, wherein the lock actuator 412, 414 is caused to release or retain the securing member 110, 120 according to the preceding description. In this way the controller may control whether the first and second parts 132/132' and 134/134' of the piece of furniture or storage 130/130' can be opened with respect to each other, or not.

Figure 5:
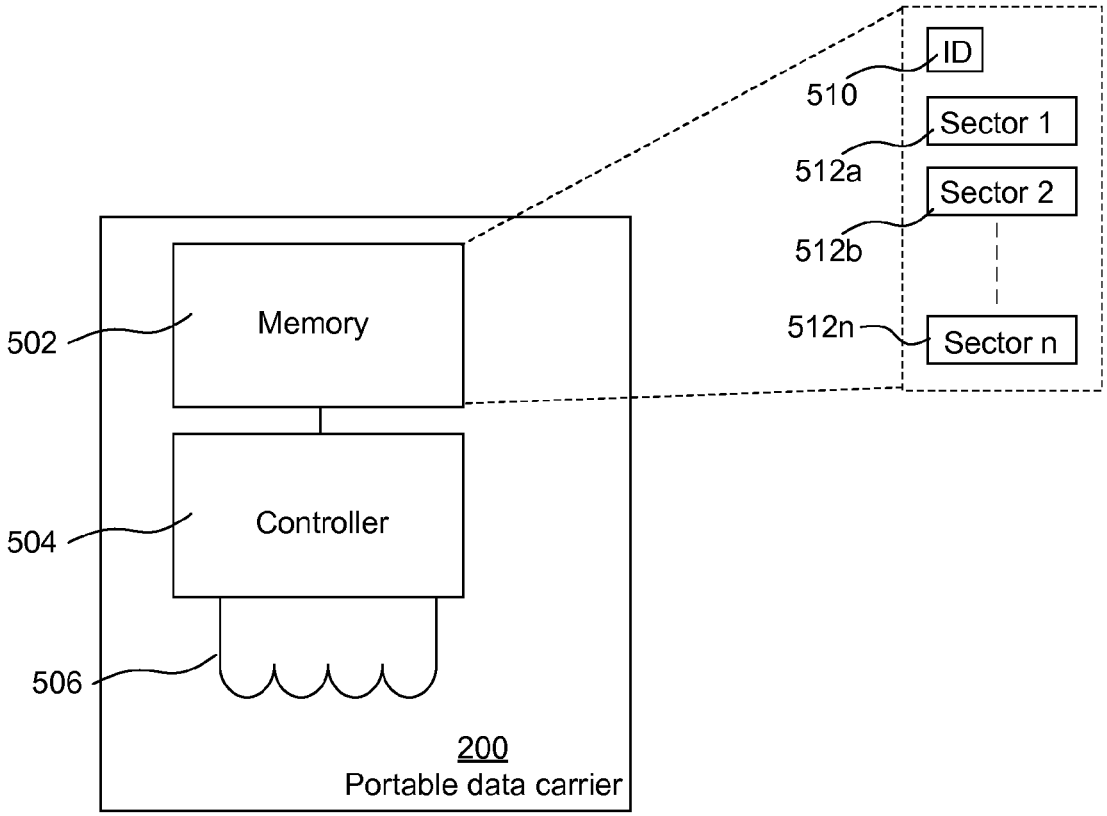
FIG. 5 is a schematic block diagram of parts comprised in a portable data carrier according to the above.

Reference is now made to FIG. 5 which illustrates the portable data carrier 200. As previously mentioned, in the present embodiment the portable data carrier 200 is an electronic or digital key of smart card or proximity tag type for RFID interrogation or reading at 13.56 MHz in accordance with the ISO/IEC 14443A standard. The data carrier 200 has a memory 502, a controller 504 and a passive RFID communication means 506, by means of which the lock device 100 can read a seat of data being stored in the memory 502. In the present embodiment the RFID communication means 506 comprises an electric coil.

The memory 502 has a unique ID 510 for the data carrier, wherein the ID is firmly stored and thus cannot be changed in the present embodiment, and a number of sectors 512*a*-512*n* in a memory bank. The contents in the sectors 512*a*-512*n* can be changed by means of the central unit 310 and its associated RFID transmitter/receiver 320 according to FIG. 3.

Figure 6A:
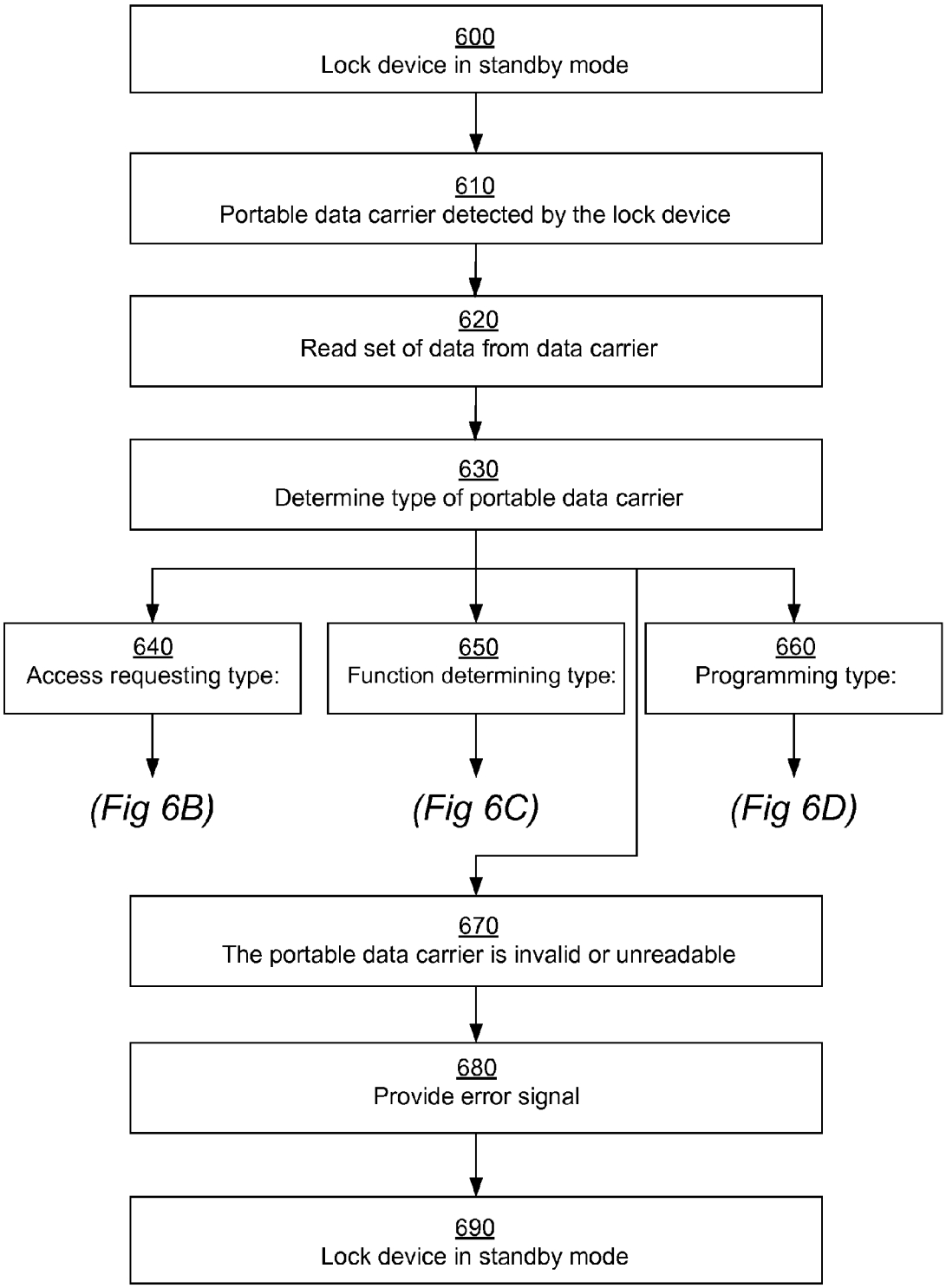
FIG. 6A is a schematic flowchart diagram of an overall operating principle for the electric lock device.

The overall operating principle for the electric lock device 100 is shown in FIG. 6A. During periods of inactivity, the lock device 100 is kept in a standby or idle mode, see step 600, in which the controller 404 and other parts consume no or only a minimum power. When a portable data carrier 200 is brought into a close vicinity of the lock device 100, the controller 404 detects this in a step 610. The actual detection and the resulting awakening of the controller 404 can occur in different ways depending on implementation; one embodiment uses a proximity sensor (not shown in the figures) of for instance optical or infrared type to detect that there is an object—probably a portable data carrier 200—in the vicinity of the lock device 100. Alternatively, the controller 404 regularly transmits, via the RFID transmitter/receiver 402, 404, short probe pulses, which interfere with the coil 506 in the RFID communication means 506 of the data carrier 200 in a detectable way for the lock device 100.

When the detection of the (presumed) data carrier 200 has been done in step 610, the controller 404 transmits a read pulse via the RFID transmitter/receiver 402, 404 to the data carrier 200 in a data reading step 620. The read pulse contains sufficient energy to drive the controller 504 in the data carrier 200, via the coil 506 in the RFID communication means 506, to retrieve a stored set of data from the memory 502, and to transmit this set of data via the RFID communication means 506 to the lock device 100. In step 620 the controller 404 in the lock device 100 hence reads, via the RFID transmitter/receiver 402, 404 of the lock device, a set of data from the memory 502 in the portable data carrier 200.

Based on the read set of data, the controller 404 can determine a type of the portable data carrier 200 (see 630 in FIG. 6A). According to the invention, there are at least the following possible types: access requesting type (see 640 in FIG. 6A) and function determining type (see 650 in FIG. 6A). In the present and preferred embodiment, there is also a programming type (see 660 in FIG. 6A).

Figure 6B:
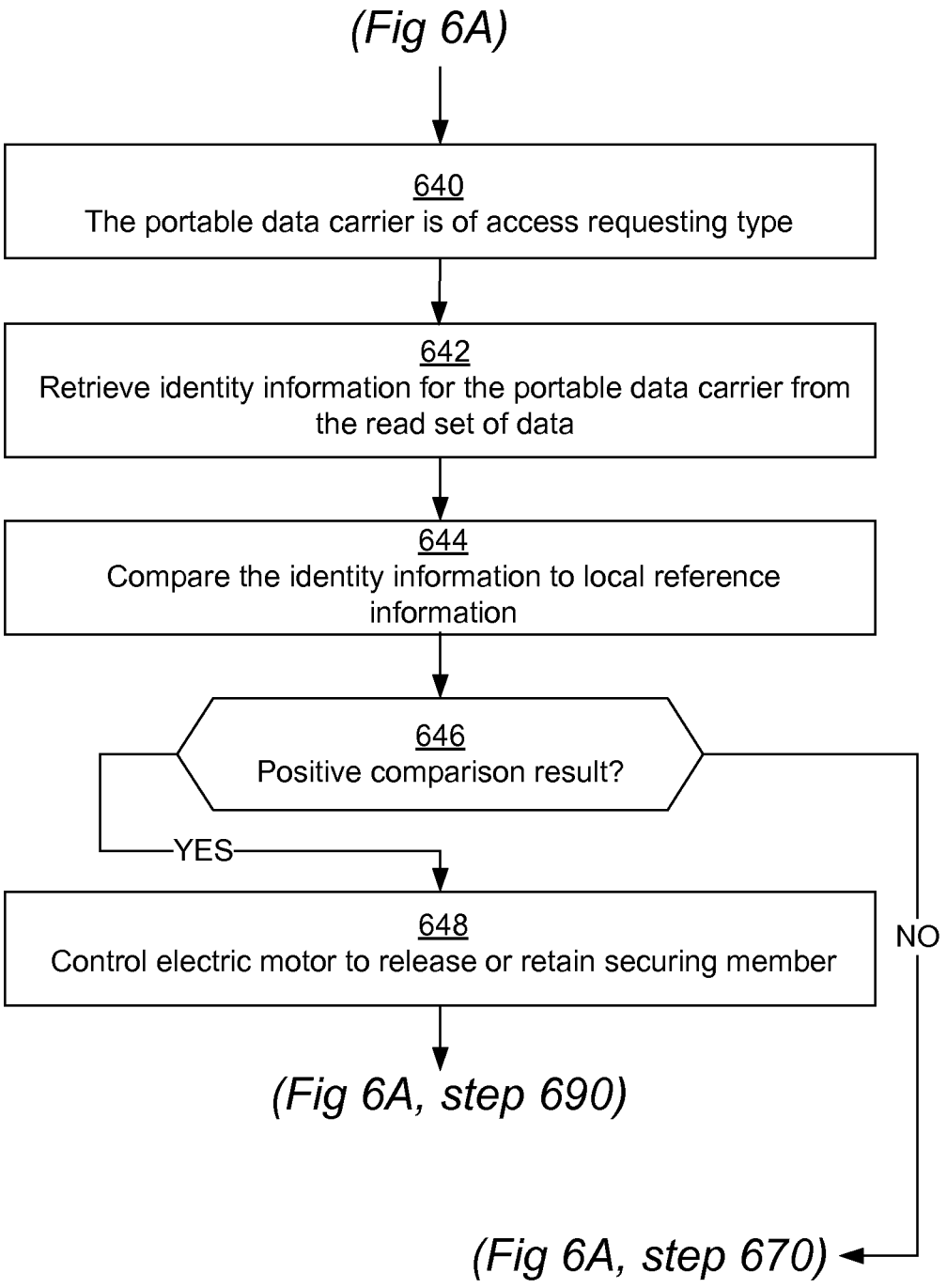
FIG. 6B is a schematic flowchart diagram of an operating principle for the electric lock device when the portable data carrier is of access requesting type.
Figure 6C:
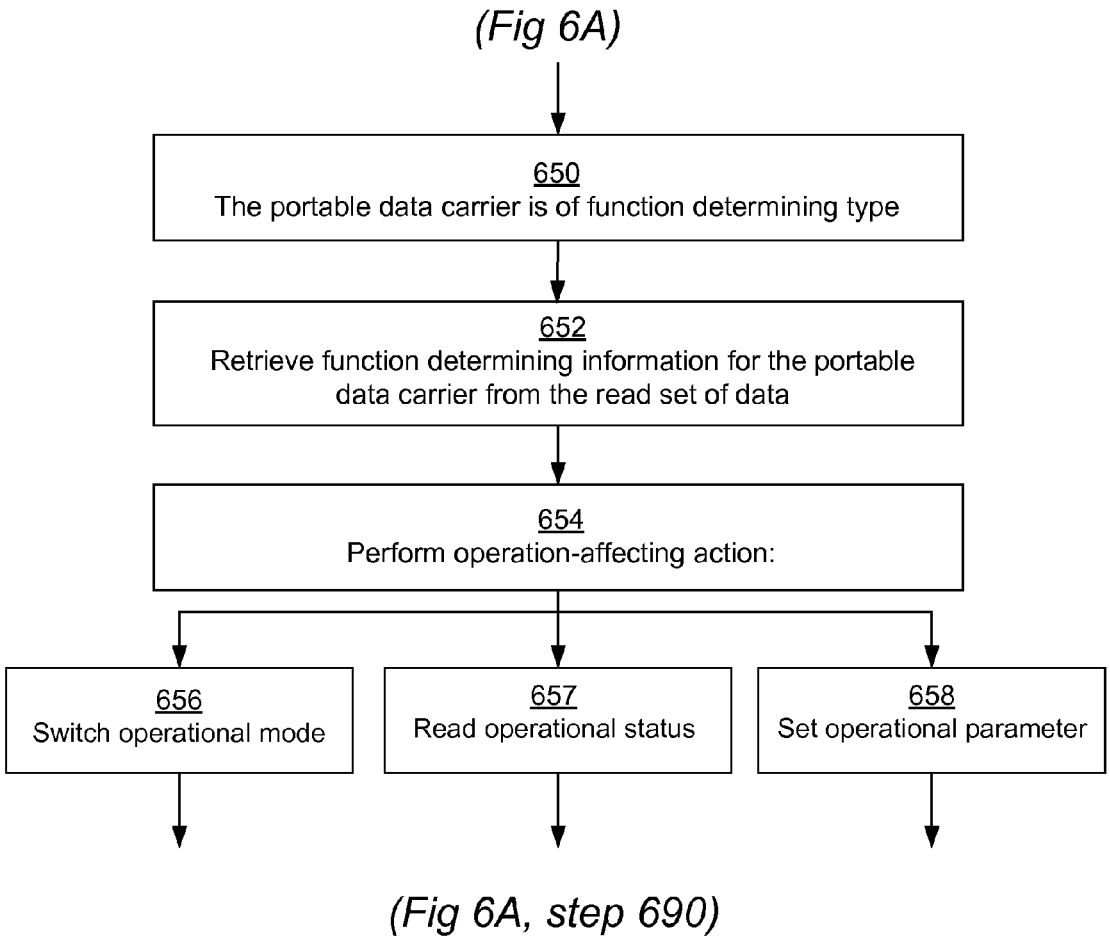
FIG. 6C is a schematic flowchart diagram of an operating principle for the electric lock device when the portable data carrier is of function determining type.
Figure 6D:
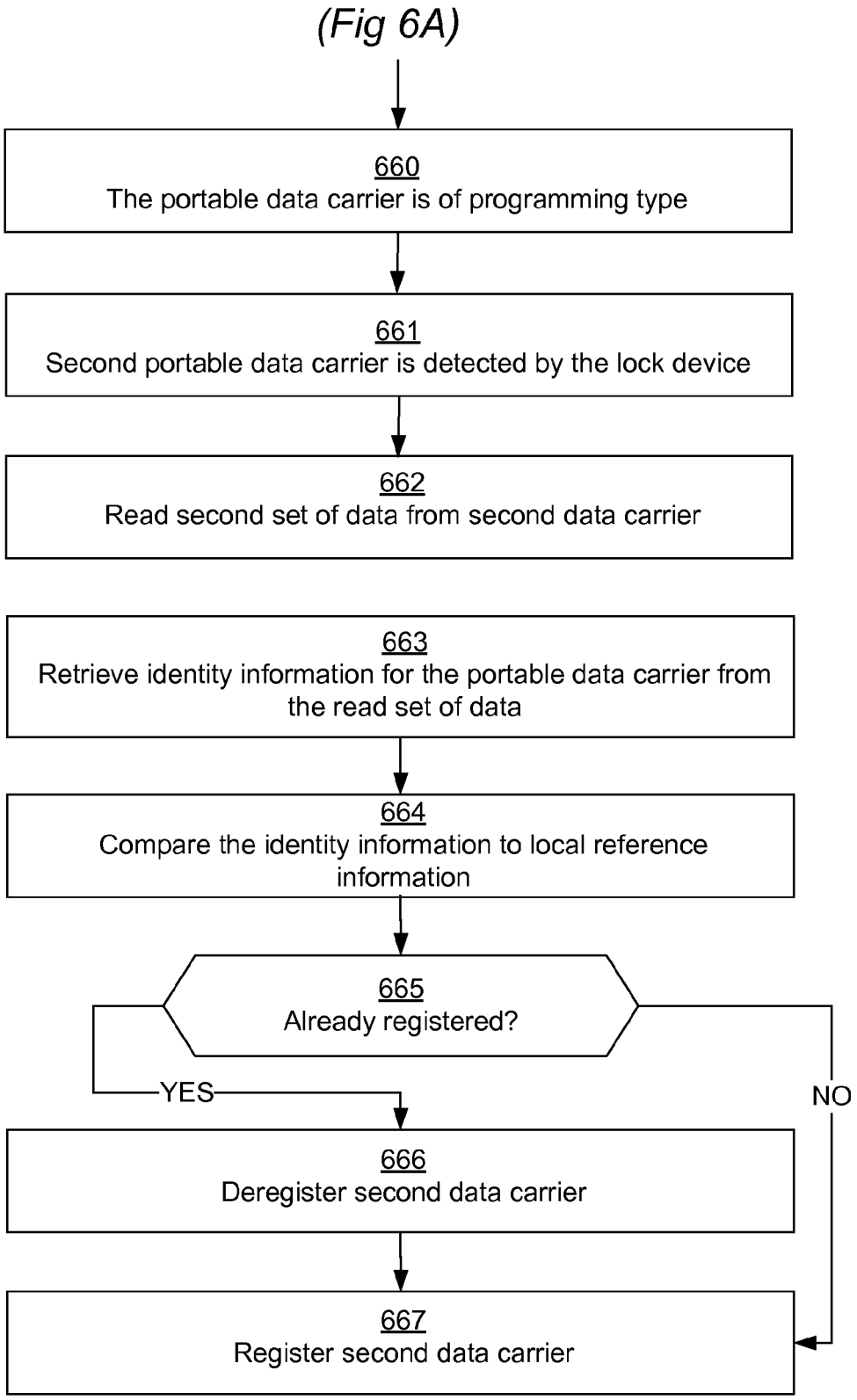
FIG. 6D is a schematic flowchart diagram of an operating principle for the electric lock device when the portable data carrier is of programming type.

The operating principle for the controller 404 in the electric lock device 100 when the portable data carrier 200 is of access requesting type is shown in FIG. 6B. The operating principle for the controller 404 in the electric lock device 100 when the portable data carrier 200 is of function determining type is shown in FIG. 6C. The operating principle for the controller 404 in the electric lock device 100 when the portable data carrier 200 is of programming type is shown in FIG. 6D.

The data carrier 200 being of access requesting type means that it is a smart card or a proximity tag which is intended to control the unlocking (i.e., the opening of the piece of furniture or storage) and/or the locking (i.e., the closing of the piece of furniture or storage) of the lock functionality which is provided by the lock device 100 in cooperation with the securing member 110/120. A data carrier 200 of access requesting type can for instance be issued to a regular user, or a group of users, of the piece of furniture or storage in question, to a temporary user (guest or visitor), or to a "superuser" who for operational reasons must be able to access a larger number of furniture or storage for a larger number of users (comparable to a master key principle in a mechanical lock system based on physical keys).

As appears from FIG. 6B, the operating principle 404 when the portable data carrier 200 is of access requesting type is as follows.

In a step 642 the controller 404 retrieves identity information for the portable data carrier 200 from the set of data read in step 620. The identity information may be constituted by a fixed identity 510 for the data carrier 200, and/or an identity which can be changed by the central unit 310 and is stored in any of the sectors 512*a*-512*n* in the memory 502 of the data carrier 200.

In a step 644 the controller 404 compares the identity information to the reference information 405*a* stored in the memory 405. The reference information contains a definition of a set of access-approved portable data carriers 202-210, one or several, previously having been programmed into the lock device 100 in the manner which is described below for FIG. 6D.

In a step 646 the controller 404 evaluates whether the comparison result is positive, i.e. if according to the identity information in the set of data read from the data carrier 200 the reference information 405*a* indicates that the user in question is approved/authorized. When the comparison result is positive, the controller 404 will control the electric motor 410 in a step 648, by providing the control signal 408, to cause the lock actuator 412, 414 to release or retain the securing member 110/120, depending on a current state and a current operational mode.

This is so, since the operating program 405*b* of the controller comprises a plurality of different operational modes having mutually different principles for access control. The present embodiment includes inter alia the following operational modes:

Operational Mode 1

The lock device 100 has an unlocked (open) state by default. Approved users (i.e. users having a respective data carrier 200 which is registered as approved in the lock device) can both lock (close) and unlock (open) manually by bringing the respective data carrier 200. When there are several users registered as approved in the lock device, any one of them may both lock and unlock; and the same user does not have to perform both actions.

Operational Mode 2 The lock device 100 has a locked (closed) state by default. Approved users can unlock (open) manually by bringing the respective data carrier 200, whereas the lock device will lock automatically after a certain time.

Operational Mode 3

The lock device 100 has an unlocked (open) state by default. The user who locks is also the user who may later unlock. Hence, the user does not have to be registered in advance as approved in the lock device, but this can be done in conjunction with locking. Then, when the user has unlocked, any user may use the lock device at a later occasion by locking it again. Operational mode 3 is particularly suitable for public environments, where the storage is for instance a cabinet in a locker room or a storage box at a station for public transportation, a school or similar.

Operational Mode 4

Like operational mode 3, with the difference that the lock device has an "escape protection" in that the controller 100 automatically unlocks when a certain time period, such as 12 h, has elapsed since locking took place.

Operational Mode 5

Like operational mode 4, with the difference that the controller 100 automatically unlocks when another time period, such as 2 h, has elapsed since locking took place.

As appears from FIG. 6C, the operating principle for the controller 404 when the portable data carrier 200 is of function determining type is as follows.

In a step 652 the controller 404 retrieves function determining information for the lock device 100 from the set of data read in step 620. The function determining information has been stored in the section 512*a*-512*n* in the memory 502 of the data carrier 200, and can hence be changed by the central unit 310.

In response to the content of the function determining information, the controller 404 performs an action affecting the operation of the lock device in a step 654. The operation-affecting action is any of a plurality of different possible actions affecting the operation of the lock device 100. All, some or at least one of these operation-affecting actions is/are is variable-controlled and based on at least one variable value comprised in the function determining information retrieved from the set of data read from the data carrier 200.

A first possible type of operation-affecting action is to switch, in a step 656, to any of a plurality of different operational modes having mutually different access control principles for the lock device 100. The function determining information may hence specify that the controller 404 shall switch to any of the operational modes 1-5 which have been described above. The operational mode to be switched to may be specified by a variable value in the function determining information.

Variable-based control may also involve specifying the duration of the time period after which the controller 404 shall automatically cause unlocking in operational mode 4 or 5. The variable in the function determining information may hence specify a duration expressed as a number of minutes, hours and/or days, or alternatively an absolute time and/or date value (in the latter case, the lock device 100 will have to be provided with a real-time clock not shown in the drawings).

Another possible variable-based control may be to specify a maximum number of accesses that users of temporary type shall be allowed. The maximum number may be specified as a numerical value in the function determining information, wherein the controller 404 applies a counter in the reference information 405*a* for users of the type in question.

A second possible type of operation-affecting action is to read, in a step 657, an operational status of the lock device 100. Operational status may for instance be a current charge level of the local power source 406. The read operational status may be fed back directly to the person bringing the data carrier 200 of function determining type by an acoustical or visual signal in a user interface of the lock device 100. Such a user interface is not shown in the figures but may include light emitting diodes, a speaker element, a display or similar.

Alternatively, the read operational status may be transferred to the memory 502 of the data carrier 200 by the RFID transmitter/receiver 402, 404 in the lock device and the RFID communication means 506 in the data carrier 200. Such a transferred operational status may then in turn be read from the data carrier 200, for instance by the central unit 310.

Another example of readable operational status is usage history for the lock device 100. During operation, the controller may successively store information in the memory 405 regarding users who request access to the piece of furniture/storage and in this way compile a readable usage history.

A third possible type of operation-affecting action is to set, in a step 658, an operational parameter of the lock device 100. Such an operational parameter may be whether the lock device 100 shall use feedback through the aforementioned user interface of the lock device 100 (for instance in the form of an acoustical or visual signal) to users bringing a data carrier 200 of access requesting type. One example may be that an error signal shall be given in a step 680 in FIG. 6A if the controller 404 has not been able to make a determination of the type of the data carrier 200 in step 630, or if there is no positive comparison result in step 646. A variable value in the function determining information shall hence specify whether such feedback shall be given or not, for instance by a parameter SOUND ON or SOUND OFF.

Another operational parameter which may be adjustable by a variable value in the function determining information may be whether the controller 404 in the lock device 100 shall compile a usage history 405, and/or whether such usage history shall be readable according to the above.

Also data carriers 200 of access requesting type may, in their readable set of data, contain one or more variable values for affecting the controller 404. Examples of such possible variables are the maximum number of passages for which the data carrier 200 can be used (for instance by a user of temporary type), the maximum number of days which the data carrier 200 may be used, a user name to be stored by the controller 404 in the reference information 405*a* for the data carrier in question, etc.

As appears from FIG. 6D, the operating principle for the controller 404 when the portable data carrier 200 is of programming type is as follows.

According to the invention, the lock device 100 may be programmed without special equipment to reflect changes in the group of users which shall have access to the piece of furniture or storage in question. New users may hence be added for the lock device 100, and existing users may be deleted. The principle is that a person, for instance an operation manager, will bring a first data carrier 200 of programming type and present it to the lock device 100. The controller 404 notices that the first data carrier 200 is of programming type and therefore enters into a programming mode. Then, the person may present a second data carrier 200, now being of access requesting type, to the lock device 100. If this second data carrier is new to the lock device 100, i.e. is intended to belong to a new user, the controller 404 may register the second data carrier 200 in the reference information 405*a* in the memory 405. If on the other hand the second data carrier 200 is already known to the lock device 100, i.e. belongs to an existing user who shall no longer be approved for access, the controller 404 may deregister the second data carrier 200 in the reference information 405*a* in the memory 405.

When the controller 404 has entered into the programming mode in response to having read a first data carrier 200 of programming type in step 660, it will accordingly in a step 661 in FIG. 6D detect the second data carrier 200 of access requesting type.

In a step 662 the controller 404 reads a set of data from the memory 502 in the second portable data carrier 200 through the RFID transmitter/receiver 402, 404, of the lock device, in the same way as has been described above for step 620 in FIG. 6A.

In a step 663 the controller 404 retrieves identity information for the second portable data carrier 200 from the set of data read in step 662, in the same way as has been described above for step 642 in FIG. 6B.

In a step 664 the controller 404 compares the identity information to the reference information 405*a* stored in the memory 405, in the same way as has been described above for step 644 in FIG. 6B. In a step 665 the controller 404 evaluates whether the identity information is already registered in the reference information 405*a*. If this is the case, it means that the second data carrier 200 is already known to the lock device 100, i.e. belongs to an existing user who shall no longer be approved for access, wherein the controller 404 in step 666 deregisters the second data carrier 200 in the reference information 405*a* in the memory 405.

If the outcome in step 665 on the other hand is the opposite, this means that the second data carrier 200 is not known to the lock device 100, i.e. belongs to a new user, wherein the controller 404 in step 667 registers the second data carrier 200 in the reference information 405*a* in the memory 405.

The present invention has been described with reference to a number of exemplifying embodiments. Modifications of these embodiments, as well as other embodiments, may however be possible within the scope of the patent claims, as is readily realized by a skilled person. For instance, it shall be noticed in particular that the determination of type in step 630 does not have to be performed as a separate step before the subsequent program branches 640, 650 or 660; the determination of type may alternatively be done in conjunction with the retrieval of the identity information and the function determining information from the read set of data in step 642 and 652, respectively. In an alternative embodiment, the identity information as well as the function determining information may always be retrieved (to the extent that they exist in the particular case), to make the foundation of the determination of type.

Furthermore, the identity information and the function determining information do not have to be physically separate information sets but may be part of the same information set.

As regards the securing member, the following shall be noticed in particular. As previously mentioned, the securing member as such is not central to the invention. Its purpose is to interact with the electric lock device and hence allow locking and unlocking, respectively, of the piece of furniture or storage, so that the first and second parts can be opened with respect to each other, and kept in a fixed position with respect to each other, respectively. The engagement/disengagement of the securing member occurs as mentioned by the controller in the lock device sending a control signal to the electric activator, which will activate the lock actuator that in turn releases or retains the securing member mounted to the second part of said piece of furniture or storage. No particular technical limitation shall be applied as regards how this engagement/-disengagement occurs, nor in how the securing member, the lock actuator and the electric activator are designed.

For instance, the securing member does not have to be formed as a separate element in metal or other material different from the material of the second part of the piece of furniture or storage. In such embodiments, the securing member may be formed as for instance a bore, recess or slot in the second part of the piece of furniture or storage, wherein a member of the lock actuator protruding from the lock device (or a separate protruding element being connected with the lock actuator) interacts with this bore, recess or slot. The expression "a securing member mounted to the second part of said piece of furniture or storage" may thus include such a bore, recess or slot formed in the second part of the piece of furniture or storage.

The securing member 110 is mounted by means of suitable anchoring means, such as screws or bolts (see openings 119 in FIG. 1C), to the second part 134 of the piece of furniture or storage 130, as appears from FIG. 1B. The reason why the apparatus housing 104 has two openings 102*a*, 102*b* in this embodiment is to offer more flexibility in how the lock device 100 and the securing member 110 (and 120, respectively) can be mounted spatially with respect to each other, thereby allowing better flexibility since the lock device 100 can be used with different kinds of furniture or storage. In the embodiment according to FIG. 1C, the protruding part 112 of the securing member 110 is intended to fit in the opening 102*b* in the electric lock device 100.

The securing member 110 in FIG. 1C is not central to the invention and is therefore only described in brief. The securing member 110 is in particular intended for drawers, hatches and sliding doors, and has a body 114 and an ejector 116 for automatic opening of the drawer, hatch or sliding door upon unlocking by means of the lock device. The ejector 116 is hence arranged to open the drawer, hatch or sliding door by a certain amount, such as 20 mm. The function of the ejector 116 can be deactivated, if desired at installation, by use of a blocking member 118.

The invention claimed is:

1. An electric lock device for furniture and storage, comprising:

an apparatus housing for mounting of the lock device to a first part of a piece of furniture or storage which further has a second part, wherein the first and second parts can be opened and closed with respect to each other;

a local power source for powering the lock device as an autonomously operating device;

an RFID transmitter/receiver for contactless communication with portable data carriers in a vicinity of the lock device;

a controller;

a memory associated with the controller and adapted to store reference information defining a set of access-approved portable data carriers;

an electric activator coupled for activating a lock actuator upon receiving a control signal from the controller, to cause the lock actuator to release or retain a securing member mounted to the second part of said piece of furniture or storage, wherein the controller is configured to:

detect that a portable data carrier is present in a vicinity of the lock device;

read, through said RFID transmitter/receiver, a set of data from a memory in the portable data carrier;

based on the set of data read from the memory, determine a type of the portable data carrier among at least the following possible types: access requesting type and function determining type;

if the portable data carrier is of access requesting type, retrieve identity information for the portable data carrier from the set of data read from the memory, compare the identity information to the reference information stored in said memory, and in response to a positive comparison result control the electric activator to cause the lock actuator to release or retain a securing member;

if the portable data carrier is of function determining type, retrieve function determining information from the set of data read from the memory and in response perform an action selected from a group of actions affecting an operation of the lock device, the group consisting of:

switch to any of a plurality of different operational modes having different principles for access control;

read an operational status of the lock device; and set an operational parameter of the lock device, wherein at least one of the actions in the group of actions affecting an operation of the lock device is variable-controlled and based on a variable value comprised in the function determining information retrieved from the set of data read from the memory.

2. The electric lock device according to claim 1, wherein a variable value in the function determining information specifies the operational mode to be switched to among said plurality of different operational modes.

3. The electric lock device according to claim 1, wherein a variable value in the function determining information specifies a duration after which the controller shall automatically cause unlocking in an operational mode among said plurality of different operational modes.

4. The electric lock device according to claim 1, wherein a variable value in the function determining information specifies a maximum number of accesses that a user of a temporary type shall be allowed.

5. The electric lock device according to claim 1, wherein a variable value in the function determining information specifies an adjustable operational parameter of the lock device, wherein the variable value pertains to at least any of the following:

whether feedback through a user interface of the lock device is to be given to users who bring a data carrier of access requesting type;

whether the controller shall successively store information in the memory about users who request access to the piece of furniture or storage by means of data carriers of access requesting type and in this way compile a usage history;

whether such usage history shall be readable by a user who brings a data carrier of function determining type.

6. The electric lock device according to claim 1, wherein the controller is configured to:

based on the set of data read from the memory, determine a type of the portable data carrier among at least the following possible types: access requesting type, function determining type and programming type;

if the portable data carrier is of programming type, enter into a programming mode in which the controller is further configured to:

detect that a second portable data carrier is present in a vicinity of the lock device;

read, through said RFID transmitter/receiver, a second set of data from a memory in the second portable data carrier;

retrieve identity information for the second portable data carrier from the second set of data read from the memory in the second portable data carrier;

if the identity information for the second portable data carrier appears in the set of access-approved portable data carriers defined by the reference information, deregister the second portable data carrier from being approved in the reference information; and if the identity information for the second portable data carrier does not appear in the set of access-approved portable data carriers defined by the reference information in said memory, register the second portable data carrier as being approved in the reference information.

7. The electric lock device according to claim 1, wherein the RFID transmitter/receiver is adapted for contactless communication with portable data carriers in a vicinity of the lock device in accordance with a standard for contactless smart cards, and wherein said set of access-approved portable data carriers are contactless smart cards or proximity tags.

8. The electric lock device according to claim 1, configured for mounting to at least one of the following:

drawer;

hatch;

sliding door;

sliding cabinet; or drawer underneath a desktop.

9. An access control system for furniture and storage, comprising:

a first number of electric lock devices, each defined in accordance with claim 1;

a second number of portable data carriers; and a central unit with an associated RFID transmitter/receiver capable of writing function determining information and/or identity information to the memory in an individual portable data carrier among said second number of portable data carriers.

10. The access control system according to claim 9, wherein said second number of portable data carriers are contactless smart cards or proximity tags.

* * * * *